US005670077A

United States Patent [19]

Carlson et al.

[11] Patent Number: 5,670,077

[45] Date of Patent: Sep. 23, 1997

[54] AQUEOUS MAGNETORHEOLOGICAL MATERIALS

[75] Inventors: J. David Carlson, Cary; Jeannine C. JonesGuion, Durham, both of N.C.

[73] Assignee: Lord Corporation, Cary, N.C.

[21] Appl. No.: 544,689

[22] Filed: Oct. 18, 1995

[51] Int. Cl.[6] ..... H01F 1/26; H01F 1/144

[52] U.S. Cl. ..... 252/62.52; 252/62.53; 252/62.54

[58] Field of Search ..... 252/62.53, 62.54, 252/62.52

[56] References Cited

U.S. PATENT DOCUMENTS

| | | | |
|---|---|---|---|
| 3,612,630 | 10/1971 | Rosensweig | 308/10 |
| 3,917,538 | 11/1975 | Roswnsweig | 252/62.51 |
| 4,019,994 | 4/1977 | Kelley | 252/62.52 |
| 4,169,804 | 10/1979 | Yapel, Jr. | 252/62.53 |
| 4,582,622 | 4/1986 | Ikeda et al. | 252/62.53 |
| 4,719,027 | 1/1988 | Raistrick et al. | 252/62.53 |
| 5,277,282 | 1/1994 | Umemura | 188/290 |
| 5,284,330 | 2/1994 | Carlson et al. | 188/267 |
| 5,382,373 | 1/1995 | Carlson et al. | 252/62.55 |
| 5,505,880 | 4/1996 | Kormann et al. | 252/62.54 |

FOREIGN PATENT DOCUMENTS

| | | |
|---|---|---|
| WO-A-94/10694 | 5/1994 | WIPO . |
| WO-A-94/10692 | 5/1994 | WIPO . |
| WO-A-94/10693 | 5/1994 | WIPO . |

OTHER PUBLICATIONS

Patent Abstracts of Japan, vol. 009, No. 267 (C-310), 24 Oct. 1985 & JP.A.60 115667 (Kogyo Gijutsuin; others: OJ), 22 Jun. 1985.

*Primary Examiner*—Melissa Bonner
*Attorney, Agent, or Firm*—Wayne W. Rupert

[57] ABSTRACT

A magnetorheological material that includes magnetic particles; at least one water-soluble suspending agent selected from the group consisting of cellulose ether and biosynthetic gum; and water. The material can have a high particle loading, minimizes waste disposal problems, and can be produced at a lower cost relative to magnetorheological materials that include hydrophobic-oil type fluids as a carrier fluid.

25 Claims, No Drawings

AQUEOUS MAGNETORHEOLOGICAL MATERIALS

FIELD OF THE INVENTION

The present invention relates to fluid materials which exhibit substantial increases in flow resistance when exposed to magnetic fields. More specifically, the present invention relates to magnetorheological materials which utilize as a carrier fluid water and a water-soluble suspending agent.

BACKGROUND OF THE INVENTION

Fluid compositions which undergo a change in apparent viscosity in the presence of a magnetic field are commonly referred to as Bingham magnetic fluids or magnetorheological materials. Magnetorheological materials normally are comprised of ferromagnetic or paramagnetic particles, typically greater than 0.1 micrometers in diameter, dispersed within a carrier fluid and in the presence of a magnetic field, the particles become polarized and are thereby organized into chains of particles within the fluid. The chains of particles act to increase the apparent viscosity or flow resistance of the overall material and in the absence of a magnetic field, the particles return to an unorganized or free state and the apparent viscosity or flow resistance of the overall material is correspondingly reduced.

Traditional magnetorheological materials such as those described, for example, in WO-A-9410694, WO-A-9410692 and WO-A-9410693, have relied on hydrophobic oil-type fluids as the carrier fluid for the magnetizable particles. Hydrophobic oil carrier fluids have been found to suffer from several disadvantages. For example, hydrophobic oils are not capable of sufficiently suspending the highly dense magnetizable particles within the carrier fluid. Hence, traditional magnetorheological materials exhibit a high rate of particle settling which causes substantial inconsistencies in performance of the magnetorheological material due to unequal distribution of the particles throughout the carrier fluid. Furthermore, hydrophobic oil carrier fluids cannot accept large amounts of magnetizable particles without experiencing a significant increase in real viscosity. This increase in viscosity upon high particle loading is particularly disadvantageous given the fact that the yield strength of a given magnetorheological material is proportionate to the volume of particle component. The strength of traditional magnetorheological materials have therefore been significantly limited since a high particle loading would result in highly viscous materials which could not be effectively utilized in a magnetorheological device. Finally, traditional magnetorheological materials are environmentally undesirable since the hydrophobic oil carrier fluids create waste disposal problems and cause difficulties in recycling of the metal particles. The traditional oil-based magnetorheological materials are also difficult to clean up once a spill has occurred and are difficult to flush from a magnetorheological device.

U.S. Pat. No. 3,612,630 relates to a magnetic fluid that can include water as a carrier fluid and a surface active agent such as a fatty acid.

U.S. Pat. No. 3,917,538 relates to a method for producing a ferrofluid that contains magnetic particles that have a particle size of 300 Å (approximately 0.03 μm) at the most. According to one embodiment, the method includes preparing a first ferrofluid composition of magnetic particles in a dispersant in water, adding a flocculating agent to the first ferrofluid, recovering the dispersant-free magnetic precipitated particles, coating the surface of the particles with a second dispersant and redispersing the coated particles is a second carrier liquid to provide a second ferrofluid.

U.S. Pat. No. 4,169,804 relates to a composite microparticle that includes a magnetically responsive material dispersed throughout a permeable solid water-insoluble matrix selected from proteinaceous materials, polysaccharides and mixtures thereof.

U.S. Pat. No. 4,019,994 relates to a process for preparing a suspension of 5 to 30 weight percent magnetic iron oxide or iron hydroxyoxide in an aqueous medium in the presence of 1 to 20 weight percent sulfonated petroleum dispersant.

A need currently exists for a magnetorheological material which is stable with respect to particle settling and which can maintain a high particle loading without a substantial increase in viscosity. Such a magnetorheological material should also be environmentally acceptable and capable of easy clean-up and flushing.

SUMMARY OF THE INVENTION

The present invention is a magnetorheological material which is extremely stable with respect to particle settling and which can handle a high loading of particles without exhibiting a substantial increase in viscosity. The present magnetorheological material is also environmentally acceptable since the particle component can easily be recycled and the magnetorheological material itself is capable of easy cleanup and flushing. The present invention is based on the discovery that water can be utilized as a carrier fluid so long as an appropriate water-soluble suspending agent is utilized in combination with the water. Specifically, the magnetorheological material of the present invention comprises a particle component; at least one water-soluble suspending agent selected from the group consisting of cellulose ethers such as sodium carboxymethylcellulose, methyl hydroxyethylcellulose and other ether derivatives of cellulose and biosynthetic gums such as xanthan gum, welan gum and rhamsan gum; and water.

It has been discovered that the combination of water and an appropriate water-soluble suspending agent renders the corresponding magnetorheological material highly non-Newtonian, thereby inhibiting the settling of particles in spite of their high density and large size. By "non-Newtonian" it is meant that the magnetorheological material when not subjected to a magnetic field is thixotropic, pseudoplastic (exhibits shear thinning) and has a finite yield strength. The non-Newtonian nature of the present magnetorheological material allows it to withstand high particle loading without a corresponding substantial increase in viscosity. The aqueous nature of the magnetorheological materials minimizes waste disposal problems and allows the particles to be easily recycled from the material. The aqueous magnetorheological material can also be easily cleaned up or flushed from a device or surface.

It should also be noted that the present magnetorheological material can be prepared at a cost substantially less than the cost required to prepare traditional magnetorheological materials. Specifically, the non-Newtonian nature of the magnetorheological material allows for the utilization of coarse metal powders having relatively large diameters. Coarse metal powders are much less expensive than the fine iron powders that have been required in the past. Furthermore, substantial savings are realized by utilizing water as a carrier fluid since traditional hydrophobic oil carrier fluids can be quite costly.

DETAILED OF THE DESCRIPTION OF THE INVENTION

The magnetorheological material of the present invention comprises a particle component, a water-soluble suspending agent, and water.

The particle component of the magnetorheological material of the invention can be comprised of essentially any solid which is known to exhibit magnetorheological activity. Typical particle components useful in the present invention are comprised of, for example, paramagnetic, superparamagnetic or ferromagnetic compounds. Specific examples of particle components useful in the present invention include particles comprised of materials such as iron, iron oxide, iron nitride, iron carbide, carbonyl iron, chromium dioxide, low carbon steel, silicon steel, nickel, cobalt, and mixtures thereof. The iron oxide includes all known pure iron oxides, such as $Fe_2O_3$ and $Fe_3O_4$, as well as those containing small amounts of other elements, such as manganese, zinc or barium. Specific examples of iron oxide include ferrites and magnetites. In addition, the particle component can be comprised of any of the known alloys of iron, such as those containing aluminum, silicon, cobalt, nickel, vanadium, molybdenum, chromium, tungsten, manganese and/or copper.

The particle component can also be comprised of the specific iron-cobalt and iron-nickel alloys described in U.S. Pat. No. 5,382,373. The iron-cobalt alloys useful in the invention have an iron:cobalt ratio ranging from about 30:70 to 95:5, preferably ranging from about 50:50 to 85:15, while the iron-nickel alloys have an iron:nickel ratio ranging from about 90:10 to 99:1, preferably ranging from about 94:6 to 97:3. The iron alloys may contain a small amount of other elements, such as vanadium, chromium, etc, in order to improve the ductility and mechanical properties of the alloys. These other elements are typically present in an amount that is less than about 3.0% by weight. Due to their ability to generate somewhat higher yield stresses, the iron-cobalt alloys are presently preferred over the iron-nickel alloys for utilization as the particle component in a magnetorheological material. Examples of the preferred iron-cobalt alloys can be commercially obtained under the tradenames HYPERCO (Carpenter Technology), HYPERM (F. Krupp Widiafabrik), SUPERMENDUR (Arnold Eng.) and 2V-PERMENDUR (Western Electric).

The particle component of the present invention is typically in the form of a metal powder which can be prepared by processes well known to those skilled in the art. Typical methods for the preparation of metal powders include the reduction of metal oxides, grinding or attrition, electrolytic deposition, metal carbonyl decomposition, rapid solidification, or smelt processing. Various metal powders that are commercially available include straight iron powders, reduced iron powders, insulated reduced iron powders, cobalt powders, and various alloy powders such as [48%]Fe/[50%]Co/[2%]V powder available from UltraFine Powder Technologies. The average diameter of the particles utilized herein can range from about 1 to 1000 μm and preferably range from about 1.0 to 100 μm.

The preferred particles of the present invention are carbonyl iron powders that are high purity iron particles made by the thermal decomposition of iron pentacarbonyl. Carbonyl iron of the preferred form is commercially available from ISP Technologies.

The particle component typically comprises from about 5 to 50, preferably from about 30 to 48, percent by volume of the total composition depending on the desired magnetic activity and viscosity of the overall material. This corresponds to about 29 to 89, preferably about 75 to 88, percent by weight when the carrier fluid and particle of the magnetorheological material have a specific gravity of about 1.0 and 7.86, respectively.

The water-soluble suspending agent may be a cellulose ether such as sodium carboxymethylcellulose, methyl hydroxyethylcellulose or other similar cellulose ether derivatives. The water-soluble suspending agent may also be a biosynthetic gum such as xanthan gum, welan gum or rhamsan gum. A mixture of these water-soluble suspending agents could also be employed. These materials have been discovered to have substantial temperature stability and shelf life stability. In addition, only a small amount of these materials is needed to create an effective aqueous carrier fluid. In certain circumstances it may be desirable to employ another water-soluble suspending agent in addition to one of those listed above. Two such additional water-soluble suspending agents are locust bean gum and polyethylene oxide.

The material also has a commercially useful shelf life stability. By "stability" it is meant that the particles remain substantially suspended and do not settle onto the bottom to form a thick sediment layer, a supernatant clear layer is not formed, a debilitating amount of rust does not form on the surface of the particles, and the suspending agent remains solubilized in the aqueous carrier liquid. Another advantage of the material is that if a modest amount of settling has occurred or a small slightly clear supernatant layer has formed over a period of time, the particles can be easily re-mixed with the aqueous carrier fluid. Such re-mixing occurs substantially instantaneously upon moderate movement or shaking of the material.

A particular advantage of xanthan gum is that it is substantially resistant to degradation by heat and is compatible with many of the optional additives that may be utilized in the present magnetorheological material as described in more detail below. Preferred mixtures of xanthan gum include the mixture of xanthan gum and locust bean gum and the mixture of xanthan gum and polyethylene oxide.

A particular advantage of sodium carboxymethylcellulose is that it results in a magnetorheological material that is particularly stable against gravitational settling or sedimentation for extended periods of time; i.e., periods longer than about two months. Another advantage is that sodium carboxymethylcellulose is compatible with the desirable maintenance of the pH of the magnetorheological material above 7, preferably above 10.

The water-soluble suspending agent can be utilized in an amount ranging from about 0.1 to 5, preferably from about 0.5 to 2, percent by weight, based on the total weight of the water. If there is more than 5 weight percent, the magnetorheological material can become too thick. If there is less than 0.1 percent, suspension of the particles can be difficult to maintain.

The water of the present invention may be in any form and may be derived from any source, but is preferably both deionized and distilled before use in the magnetorheological material. The water is typically utilized in an amount ranging from about 50 to 95, preferably from about 52 to 70, percent by volume of the total magnetorheological material. This corresponds to about 11 to 70, preferably about 12 to 24, percent by weight of the total magnetorheological material. If there is too much water, the force output of the magnetorheological material can be insufficient for utilization in devices. If there is an insufficient amount of water, the magnetorheological material can turn into a paste-like material.

In order to inhibit the formation of rust on the surface of the particles, particularly particles that include iron, it is preferred to utilize a rust inhibitor as an additive to the magnetorheological material. Rust inhibitors, also known as oxygen scavengers, are well known and typically comprise various nitrite or nitrate compounds. Specific examples of rust inhibitors include sodium nitrite, sodium nitrate, sodium benzoate, borax, ethanolamine phosphate, and mixtures thereof. In addition, other alkalizing agents such as sodium hydroxide may be added to insure that the pH of the magnetorheological material remains alkaline throughout its life. Descriptions of various rust inhibitors for water and water/ethylene glycol mixtures can also be found in (1) H. H. Uhlig and R. W. Revie, "Corrosion and Corrosion Control," Third Edition, John Wiley (1985); (2) M. J. Collie, editor, "Corrosion Inhibitors," Noyes Data Corp. (1983); (3) M. Ash and I. Ash, "Handbook of Industrial Chemical Additives," VCH Publications, New York (1991), section on corrosion inhibitors, pp. 783–785; (4) McCutcheon's "Volume 2: Functional Materials, North American Edition," Mfg. Confectioner Publ. Co. (1992), section on corrosion inhibitors, pp. 73–84; and (5) R. M. E. Diamant, "Rust and Rot," Argus and Robertson, London (1972), pg. 59. Furthermore, commercial rust inhibitors for water and water-based mixtures can be readily obtained from various companies such as New Age Industries, Inc., Willow Grove, Pa.

The rust inhibitor, if utilized, is typically employed in an amount ranging from about 0.1 to 10, preferably from about 1 to 5, percent by weight based on the total weight of the water utilized in the magnetorheological material.

In order to prevent freezing and to extend the usable temperature range of the present magnetorheological materials in general, it is preferred to employ a glycol compound as an additive to the magnetorheological material. Glycol compounds useful for preventing freezing are known, and examples of glycol compounds include ethylene glycol and propylene glycol, with ethylene glycol being preferred. The glycol compound, if utilized, is typically employed in an amount ranging from about 1 to 140, preferably from about 10 to 50, percent by weight, based on the total weight of the water utilized in the magnetorheological material.

The optional glycol compound and rust inhibitor additives may be conveniently utilized as a mixture of the two additives. The most well known mixtures of glycol compounds and rust inhibitors are the commercially available anti-freeze mixtures utilized in automotive cooling systems. Typically, the magnetorheological material according to the present invention is stable over a temperature range of –40° to 130° C. if up to 50 weight percent commercial anti-freeze is present and –65° to 135° C. if up to 70 weight percent commercial anti-freeze is present.

The magnetorheological materials of the present invention may also contain other optional additives such as dyes or pigments, surfactants or dispersants, lubricants, pH shifters, salts, deacidifiers, or other corrosion inhibitors. The optional additives may be in the form of dispersions, suspensions, or materials that are soluble in the water or the glycol additive. High density, water soluble salts such as barium salts may be included to increase the specific gravity of the carrier fluid and further enhance the ability of the carrier fluid to suspend dense particles.

The magnetorheological material can be used in, for example, dampers, brakes, mounts and other active or passive systems or devices for controlling vibrations and/or noise.

INVENTIVE EXAMPLES 1–20

Magnetorheological materials according to the invention were prepared for Examples 1–20 utilizing the ingredients listed below in Table 1 in grams.

Examples 1–3 are made by first dispersing the sodium carboxymethylcellulose powder in a commercial anti-freeze solution. The water is added while this dispersion is being agitated with a small hand mixer. Mixing or agitation continues until the sodium carboxymethylcellulose has dissolved. Next, the iron powder is added and mixing continues until the magnetorheological fluid is uniform and smooth.

Examples 4 and 5 are made by dispersing the sodium carboxymethylcellulose powder in a commercial anti-freeze. Sodium nitrite (and sodium hydroxide in the case of Example 5) is dissolved in water. The water solution is added while the anti-freeze dispersion is being agitated. Mixing or agitation continues until the sodium carboxymethylcellulose has dissolved. Next, the iron powder is added and mixing continues until the magnetorheological fluid is uniform and smooth.

Examples 8–13, 18 and 19 were made by first dispersing the xanthan gum powder, welan gum and rhamsan gum, respectively, in the commercial anti-freeze solution. The sorbitan monooleate of Example 13 is also added at this time. The water is added while this dispersion is being agitated with a small hand mixer. Mixing or agitation continues until the gum has dissolved. Next, the iron powder is added and the mixing continues until the magnetorheological fluid is uniform and smooth.

Example 7 is made by first dispersing the sodium carboxymethylcellulose in the ethylene glycol. The sodium nitrite and sodium hydroxide are next dissolved in the water. The water solution is added while the ethylene glycol dispersion is being agitated. Mixing or agitation continues until the sodium carboxymethylcellulose has dissolved. Next, the iron powder is added and mixing continues until the magnetorheological fluid is uniform and smooth.

Examples 14–17 and 20 are made by first dissolving the sodium nitrite (and sodium hydroxide in the case of Example 15) in the water. Next, while the water solution is being stirred with a small laboratory mixer, the xanthan gum powder is added and allowed to dissolve. This addition is done slowly so that lumps do not form. Mixing or agitation continues until the xanthan gum has dissolved. Next, the iron powder is added and mixing continues until the magnetorheological fluid is uniform and smooth.

Example 6 is made by first dissolving the locust bean gum and xanthan gum powders in the commercial antifreeze and then proceeding as in Examples 8–13.

Comparative Examples 21–27

Comparative Example 21 is made by first heating the water and corn starch together until the mixture boils. Boiling is allowed to continue for 2 minutes at which point the commercial antifreeze is added. After the solution has been allowed to cool, the iron powder is added and mixing continues with a hand mixer until the magnetorheological fluid is uniform and smooth.

In Comparative Example 22 polyethylene oxide is first added to the anti-freeze. In Comparative Examples 23, 25 and 26, locust bean gun is first dispersed in the anti-freeze. In Comparative Example 24, gelatin is mixed in water then heated. In Comparative Example 27, there are no additives—water and anti-freeze are mixed then the iron particles are included.

The stability of the Examples was evaluated by observing the number of days until a supernatant clear layer appears that is approximately 10% of the total height of the sample in the sample bottle. The remixability and oxidation/corrosion of the Examples after thirty days also was observed. The results are listed in Table 1.

All of the inventive Examples display a substantial magnetorheological effect as determined either by their response to small, permanent magnet, their successful operation in an magnetorheological fluid device such as those described in U.S. Pat. Nos. 5,277,282 and 5,284,330 or their operation in test machine of the sort described in U.S. Pat. No. 5,382,373.

The further usefulness of the invention is demonstrated by the ability of all of the inventive Examples to form stable suspensions that do not show either a supernatant clear layer or thick sediment after the fluids have remained quiescent for substantial periods of time ranging to more than 20 days. All of the magnetorheological fluids described in the inventive Examples assume a weak gel structure after sitting quiescent for several hours to a day. The gelled fluids have a small, but finite yield strength that prevents the high density iron particles from settling due to gravity. The yield strength is sufficiently low, however, that a small agitation quickly reverts the gel to a liquid state and re-mixes the particles.

None of the comparative Examples include a water-soluble suspending agent according to the invention. It is clear from the stability and remixability of these comparative Examples that the water-soluble suspending agent of the invention provides superior results.

TABLE 1

| INGREDIENT: | | | | | |
|---|---|---|---|---|---|
| Example No. | 1 | 2 | 3 | 4 | 5 |
| water[a] | 300 | 300 | 300 | 600 | 600 |
| commercial antifreeze[i] | 300 | 300 | 300 | | |
| ethylene glycol[m] | | | | | |
| Xanthan Gum[e] | | | | | |
| Welan Gum[d] | | | | | |
| Rhamsan Gum[d] | | | | | |
| sodium carboxymethylcellulose[g] | 3 | 4 | 4 | 3 | 3 |
| starch[f] | | | | | |
| Locust Bean Gum[h] | | | | | |
| Gelatin[n] | | | | | |
| Carrageenan[h] | | | | | |
| Gum Arabic[h] | | | | | |
| polyethylene oxide[j] | | | | | |
| sorbitan monooleate[k] | | | | | |
| sodium nitrite[j] | | | | 5 | 5 |
| sodium hydroxide[h] | | | | | 1 |
| carbonyl iron[b] | 1840 | 2700 | | 2700 | 2700 |
| reduced carbonyl iron[l] | | | 2700 | | |
| atomized iron[c] | | | | | |
| Approximate Particulate Volume Fraction | 33% | 37% | 37% | 35% | 35% |
| Stability — number days to 10% clear layer | 20+ | 20+ | 20+ | 20+ | 20+ |
| Remixability — ease of remix after 30 days | ex-cellent | ex-cellent | ex-cellent | ex-cellent | ex-cellent |
| Oxidation/Corrosion | none | none | none | trace | none |
| Example No. | 6 | 7 | 8 | 9 | 10 |
| water[a] | 400 | 400 | 300 | 400 | 300 |
| commercial antifreeze[i] | 200 | | 300 | 200 | 300 |
| ethylene glycol[m] | | 200 | | | |
| Xanthan Gum[e] | 0.8 | | 2.4 | 2.4 | 2.4 |
| Welan Gum[d] | | | | | |
| Rhamsan Gum[d] | | | | | |
| sodium carboxymethylcellulose[g] | | 4 | | | |
| starch[f] | 12.8 | | | | |
| Locust Bean Gum[h] | | | | | |
| Gelatin[n] | | | | | |
| Carrageenan[h] | | | | | |
| Gum Arabic[h] | | | | | |
| polyethylene oxide[j] | | | | | |
| sorbitan monooleate[k] | | | | | |
| sodium nitrite[j] | | 30 | | | |
| sodium hydroxide[h] | | 1 | | | |
| carbonyl iron[b] | 2000 | 2700 | 2700 | 2700 | |

TABLE 1-continued

| INGREDIENT: | | | | | |
|---|---|---|---|---|---|
| reduced carbonyl iron[l] | | | | | 2700 |
| atomized iron[c] | | | | | |
| Approximate Particulate Volume Fraction | 33% | 37% | 37% | 37% | 37% |
| Stability — number days to 10% clear layer | 5 to 10 | 20+ | 5 to 10 | 5 to 10 | 5 to 10 |
| Remixability — ease of remix after 30 days | ex-cellent | ex-cellent | good | good | good |
| Oxidation/Corrosion | none | none | none | trace | none |
| Example No. | 11 | 12 | 13 | 14 | 15 |
| water[a] | 400 | 400 | 400 | 600 | 600 |
| commercial antifreeze[i] | 200 | 200 | 200 | | |
| ethylene glycol[m] | | | | | |
| Xanthan Gum[e] | 4 | 4 | 4 | 5.3 | 5.3 |
| Welan Gum[d] | | | | | |
| Rhamsan Gum[d] | | | | | |
| sodium carboxymethylcellulose[g] | | | | | |
| starch[f] | | | | | |
| Locust Bean Gum[h] | | | | | |
| Gelatin[n] | | | | | |
| Carrageenan[h] | | | | | |
| Gum Arabic[h] | | | | | |
| polyethylene oxide[j] | | | | | |
| sorbitan monooleate[k] | | | 4.8 | | |
| sodium nitrite[j] | | | | 30 | 30 |
| sodium hydroxide[h] | | | | | 1 |
| carbonyl iron[b] | 4000 | | | 2700 | 2700 |
| reduced carbonyl iron[l] | | | | | |
| atomized iron[c] | | 2000 | 2000 | | |
| Approximate Particulate Volume Fraction | 46% | 34% | 34% | 35% | 35% |
| Stability — number days to 10% clear layer | 5 to 10 | 2 to 5 | 2 to 5 | 5 to 10 | 5 to 10 |
| Remixability — ease of remix after 30 days | good | good | good | good | good |
| Oxidation/Corrosion | none | none | none | trace | none |
| Example No. | 16 | 17 | 18 | 19 | 20 |
| water[a] | 600 | 600 | 400 | 400 | 400 |
| commercial antifreeze[i] | | | 200 | 200 | |
| ethylene glycol[m] | | | | | 200 |
| Xanthan Gum[e] | 5.5 | 6 | | | 2.4 |
| Welan Gum[d] | | | 2.4 | | |
| Rhamsan Gum[d] | | | | 2.4 | |
| sodium carboxymethylcellulose[g] | | | | | |
| starch[f] | | | | | |
| Locust Bean Gum[h] | | | | | |
| Gelatin[n] | | | | | |
| Carrageenan[h] | | | | | |
| Gum Arabic[h] | | | | | |
| polyethylene oxide[j] | | | | | |
| sorbitan monooleate[k] | | | | | |
| sodium nitrite[j] | 7.7 | 8.4 | | | 30 |
| sodium hydroxide[h] | | | | | 1 |
| carbonyl iron[b] | 4335 | 4716 | 2700 | 2700 | 2700 |
| reduced carbonyl iron[l] | | | | | |
| atomized iron[c] | | | | | |
| Approximate Particulate Volume Fraction | 48% | 50% | 37% | 37% | 37% |
| Stability — number days to 10% clear layer | 5 to 10 | 5 to 10 | 5 to 10 | 5 to 10 | 5 to 10 |
| Remixability — ease of remix after 30 days | good | good | good | good | good |
| Oxidation/Corrosion | none | none | none | trace | none |
| Example No. | 21 | 22 | 23 | 24 | 25 |
| water[a] | 400 | 400 | 400 | 400 | 400 |
| commercial antifreeze[i] | 200 | 200 | 200 | 200 | 200 |
| ethylene glycol[m] | | | | | |
| Xanthan Gum[e] | | | | | |
| Welan Gum[d] | | | | | |

TABLE 1-continued

| INGREDIENT: | | | | | |
|---|---|---|---|---|---|
| Rhamsan Gum[d] | | | | | |
| sodium carboxymethylcellulose[g] | | | | | |
| starch[f] | 25 | | | | |
| Locust Bean Gum[h] | | | 12.8 | | |
| Gelatin[m] | | | | 25 | |
| Carrageenan[h] | | | | | 25 |
| Gum Arabic[h] | | | | | |
| polyethylene oxide[j] | | 0.7 | | | |
| sorbitan monooleate[k] | | | | | |
| sodium nitrite[j] | | | | | |
| sodium hydroxide[h] | | | | | |
| carbonyl iron[b] | 2700 | 2700 | 2000 | 2700 | 2700 |
| reduced carbonyl iron[l] | | | | | |
| atomized iron[c] | | | | | |
| Approximate Particulate Volume Fraction | 37% | 37% | 33% | 37% | 37% |
| Stability — number days to 10% clear layer | <1 | ~1 | <1 | <1 | <1 |
| Remixability — ease of remix after 30 days | poor | poor | poor | poor | poor |
| Oxidation/Corrosion | none | none | none | trace | none |

| Example No. | 26 | 27 |
|---|---|---|
| water[a] | 400 | 400 |
| commercial antifreeze[i] | 200 | 200 |
| ethylene glycol[m] | | |
| Xanthan Gum[e] | | |
| Welan Gum[d] | | |
| Rhamsan Gum[d] | | |
| sodium carboxymethylcellulose[g] | | |
| starch[f] | | |
| Locust Bean Gum[h] | | |
| Gelatin[n] | | |
| Carrageenan[h] | | |
| Gum Arabic[h] | 25 | |
| polyethylene oxide[j] | | |
| sorbitan monooleate[k] | | |
| sodium nitrite[j] | | |
| sodium hydroxide[h] | | |
| carbonyl iron[b] | 2700 | 2700 |
| reduced carbonyl iron[l] | | |
| atomized iron[c] | | |
| Approximate Particulate Volume Fraction | 37% | 37% |
| Stability — number days to 10% clear layer | <1 | <<1 |
| Remixability — ease of remix after 30 days | poor | poor |
| Oxidation/Corrosion | none | none |

[a]Distilled and deionized
[b]Micropowder ™ Iron, Grade S-1640, ISP Technologies, Inc., Wayne, NJ
[c]QMP Atomet 95G, Quebec Metal Powder Ltd., Tracey (Quebec) Canada
[d]Kelco, Division of Merck, Clark, NJ
[e]KELZAN S, Xanthan Gum, Kelco Div. Of Merck, Clark, NJ
[f]"Cream" Brand Pure Corn Starch, The Dial Corp., Phoenix, AZ
[g]Carboxymethylcellulose, Sodium Salt of; Aldrich Chemical Co., Milwaukee, WI
[h]Sigma Chemical Co., St. Louis, MO
[i]PEAK Antifreeze, Peak Automotive Products, Des Plaines, IL
[j]Aldrich Chemical Co., Milwaukee, WI
[k]Sigma Chemical Co., St. Louis, MO
[l]Micropowder ™ Iron, Grade R-2430, ISP Technologies, Inc., Wayne, NJ
[m]Aldrich Chemical Co., Milwaukee, WI
[n]Knox

What is claims is:

1. A magnetorheological fluid comprising magnetic particles; at least one biosynthetic gum; and water.

2. A magnetorheological fluid according to claim 1 wherein the biosynthetic gum is selected from the group consisting of xanthan gum, rhamsan gum and welan gum.

3. A magnetorheological fluid according to claim 2 wherein the biosynthetic gum is xanthan gum.

4. A magnetorheological fluid according to claim 2 further comprising an additional material selected from the group consisting of locust bean gum and polyethylene oxide.

5. A magnetorheological fluid according to claim 1 wherein the biosynthetic gum is present in an amount of 0.1 to 5 weight percent, based on the total weight of the water.

6. A magnetorheological fluid according to claim 1 wherein the magnetic particles have an average diameter of 1 to 1000 μm.

7. A magnetorheological fluid according to claim 1 wherein the magnetic particles comprise a carbonyl iron powder.

8. A magnetorheological fluid according to claim 1 further comprising at least one rust inhibitor selected from the group consisting of a nitrite compound, a nitrate compound, sodium benzoate, borax and ethanolamine phosphate.

9. A magnetorheological fluid according to claim 8 wherein the rust inhibitor is selected from the group consisting of sodium nitrite and sodium nitrate.

10. A magnetorheological fluid according to claim 1 wherein the water is present in an amount of 50 to 95 percent by volume of the total magnetorheological material.

11. A magnetorheological fluid according to claim 1 wherein the biosynthetic gum is xanthan gum, the magnetic particles comprise carbonyl iron powder having an average diameter of 1 to 1000 μm, and the water is present in an amount of 50 to 95 percent by volume of the total magnetorheological material.

12. A magnetorheological fluid comprising magnetic particles; a carrier component for the magnetic particles comprising water; and 0.1 to 2 weight percent (based on the total weight of the water) of at least one cellulose ether.

13. A magnetorheological fluid according to claim 12 wherein the the cellulose ether is sodium carboxymethylcellulose.

14. A magnetorheological fluid according to claim 12 wherein the cellulose ether is selected from the group consisting of sodium carboxymethylcellulose and methyl hydroxyethylcellulose.

15. A magnetorheological fluid according to claim 12 further comprising an additional material selected from the group consisting of locust bean gum and polyethylene oxide.

16. A magnetorheological fluid according to claim 12 wherein the magnetic particles have an average diameter of 1 to 1000 μm.

17. A magnetorheological fluid according to claim 12 wherein the magnetic particles comprise a carbonyl iron powder.

18. A magnetorheological fluid according to claim 12 further comprising at least one rust inhibitor selected from the group consisting of nitrite compound, a nitrate compound, sodium benzoate, borax and ethanolamine phosphate.

19. A magnetorheological fluid according to claim 19 wherein the rust inhibitor is selected from the group consisting of sodium nitrite and sodium nitrate.

20. A magnetorheological fluid according to claim 20 further comprising a glycol compound.

21. A magnetorheological fluid according to claim 12 wherein the water is present in an amount of 50 to 95 percent by volume of the total magnetorheological material.

22. A magnetorheological fluid according to claim 12 wherein the cellulose ether is sodium carboxymethylcellulose, the magnetic particles comprise carbonyl iron powder having an average diameter of 1 to 1000 μm, and the water is present in an amount of 50 to 95 percent by volume of the total magnetorheological material.

23. A magnetorheological fluid according to claim 12 wherein the cellulose ether is present in an amount of 0.5 to 2 weight percent, based on the total weight of the water.

24. A magnetorheological fluid according to claim 12 wherein the magnetic particles are present in an amount of 29 to 89 weight percent, based on the total weight of the fluid.

25. A magnetorheological fluid comprising magnetic particles; at least one water-soluble suspending agent selected from the group consisting of cellulose ether and biosynthetic gum; water; and a glycol compound.

* * * * *